US007172546B2

(12) United States Patent
Fiedler

(10) Patent No.: US 7,172,546 B2
(45) Date of Patent: Feb. 6, 2007

(54) APPARATUS FOR SEALING BAG BOTTOM

(75) Inventor: Lee Fiedler, Denmark, WI (US)

(73) Assignee: Hudson-Sharp Machine Co., Green Bay, WI (US)

( * ) Notice: Subject to any disclaimer, the term of this patent is extended or adjusted under 35 U.S.C. 154(b) by 143 days.

(21) Appl. No.: 10/979,828

(22) Filed: Nov. 1, 2004

(65) Prior Publication Data

US 2006/0094580 A1 May 4, 2006

(51) Int. Cl.
*B31C 1/04* (2006.01)

(52) U.S. Cl. ..... 493/308; 493/177; 493/162; 493/243

(58) Field of Classification Search ..... 493/162, 493/177, 241, 243, 425, 308
See application file for complete search history.

(56) References Cited

U.S. PATENT DOCUMENTS 2,269,545 A * 1/1942 Moeller ..... 493/446
2,412,862 A * 12/1946 Bergstein ..... 53/481
2,598,809 A * 6/1952 Liebl ..... 493/177
3,398,660 A * 8/1968 Watrous ..... 53/590
3,541,930 A * 11/1970 Goodrich ..... 493/126
3,764,425 A * 10/1973 Neff et al. ..... 156/69
4,551,124 A * 11/1985 Mowry ..... 493/128
4,872,301 A * 10/1989 Langen et al. ..... 53/133.6
5,149,201 A * 9/1992 Benoit ..... 383/8
5,167,607 A * 12/1992 Larsen ..... 493/183
5,549,537 A * 8/1996 Focke et al. ..... 493/162
5,558,611 A * 9/1996 Focke ..... 493/162
5,632,713 A * 5/1997 Canning et al. ..... 493/162
5,697,877 A * 12/1997 Roth ..... 493/162
5,862,652 A * 1/1999 Schoeler ..... 53/551
6,419,079 B1 * 7/2002 Diehr ..... 198/626.1

* cited by examiner

*Primary Examiner*—Sameh H. Tawfik
(74) *Attorney, Agent, or Firm*—Wood, Phillips, Katz, Clark & Mortimer

(57) ABSTRACT

An apparatus for sealing the bottom of a bag includes a frame through which a bag to be folded is longitudinally advanced. The apparatus includes a pair of cooperating grippers carried by a reciprocably movable gripper carrier. The grippers are operated to opposite edges of the bag, and laterally tension the bag. The apparatus includes a vertically reciprocable fold plate which then is moved downwardly to engage and downwardly fold a leading end portion of the bag. Adhesive is applied thereto, and the bag advanced, by movement of the gripper carrier, for advancement of the folded bag to at least one pair of intermittently-driven nip rollers. The grippers are released, and the nip rollers thereafter operated to compress and complete sealing of the bag bottom.

14 Claims, 5 Drawing Sheets

APPARATUS FOR SEALING BAG BOTTOM

TECHNICAL FIELD

The present invention relates generally to an apparatus for forming a bag from web-like material, and more particularly to an apparatus for sealing the bottom of a bag by folding and adhesively sealing the bag bottom.

BACKGROUND OF THE INVENTION

Manufacture of bags from flexible materials such as paper or plastic ordinarily entails formation of a generally elongated tubular web, which is advanced through suitable bag-forming equipment to form individual ones of the bags. Such bags can be formed with inwardly extending side gussets, as well as additional specific features, depending upon the intended application.

Various techniques are known for closing and sealing the bottom of the bag as it is formed. The present invention is directed to an apparatus, and associated method, wherein a bottom end portion of a tubular bag is folded, and sealed, thus forming the desired sealed bag bottom.

SUMMARY OF THE INVENTION

An apparatus for sealing the bottom of a bag embodying the principles of the present invention includes a frame through which the bag is advanced in a longitudinal direction. The apparatus includes a pair of edge grippers mounted on a gripper carrier movably mounted on the apparatus frame. The grippers are engageable with respective opposite edges of the bag, and are movable away from each other for laterally pulling on the edges of the bag. In the illustrated embodiment, relative movement of the grippers is provided by movably mounting one of the grippers on the gripper carrier, preferably by pivotally mounting that one of the grippers on the carrier.

The apparatus further includes a folding member in the form of a vertically movable folding plate which is mounted for reciprocable vertical movement on the apparatus frame. After the edges of the bag are gripped, the folding plate engages the bag and folds an end portion of the bag, thereby defining a fold line. In the illustrated embodiment, downward movement of the folding plate of the apparatus effects bag-folding in this fashion.

The apparatus includes an adhesive applicator mounted on the frame for applying adhesive to the folded end portion of the bag. In the illustrated embodiment, the adhesive applicator is mounted for movement transversely of the frame, with the apparatus including an applicator drive for transversely moving the applicator, thus effecting application of adhesive across the width of the bag. As will be appreciated, it is within the purview of the present invention that one or more stationary adhesive applicators can alternatively be employed for adhesive application.

In order to further fold and seal the folded end portion of the bag, the present apparatus includes at least one pair of cooperating nip members, preferably provided in the form of nip rollers, for receiving the fold line of the bag. A carrier drive of the apparatus advances the gripper carrier and pair of edge grippers longitudinally of the frame to advance the fold line of the bag between the pair of cooperating nip rollers. The pair of grippers are released, and the intermittently operable nip rollers activated, thereby drawing and advancing the now completely folded bag end and bag through the nip rollers.

To further facilitate complete folding in this fashion, it is presently preferred that the folded end of the bag engage an upper edge of the folding plate, which remains in a lowered position as the bag is advanced across the top thereof, as the fold line of the bag is advanced into the cooperating nip rollers. This acts to further fold the folded end of the bag as the fold line, and folded bag end, are advanced into the nip rollers.

Thus, a method of folding a bag in accordance with the present invention comprises the steps of gripping opposite edge portions of the bag, and laterally pulling on the opposite edge portions. The method further comprises folding an end portion of the bag, and applying adhesive to the folded end portion of the bag. Finally, the folded end portion is further folded to seal the bottom of the bag, with the method preferably entailing releasing the grip on the opposite edges of the bag prior to the further folding step.

Other features and advantages of the present invention will become readily apparent from the following detailed description, the accompanying drawings, and the appended claims.

DETAILED DESCRIPTION

Figure 1:
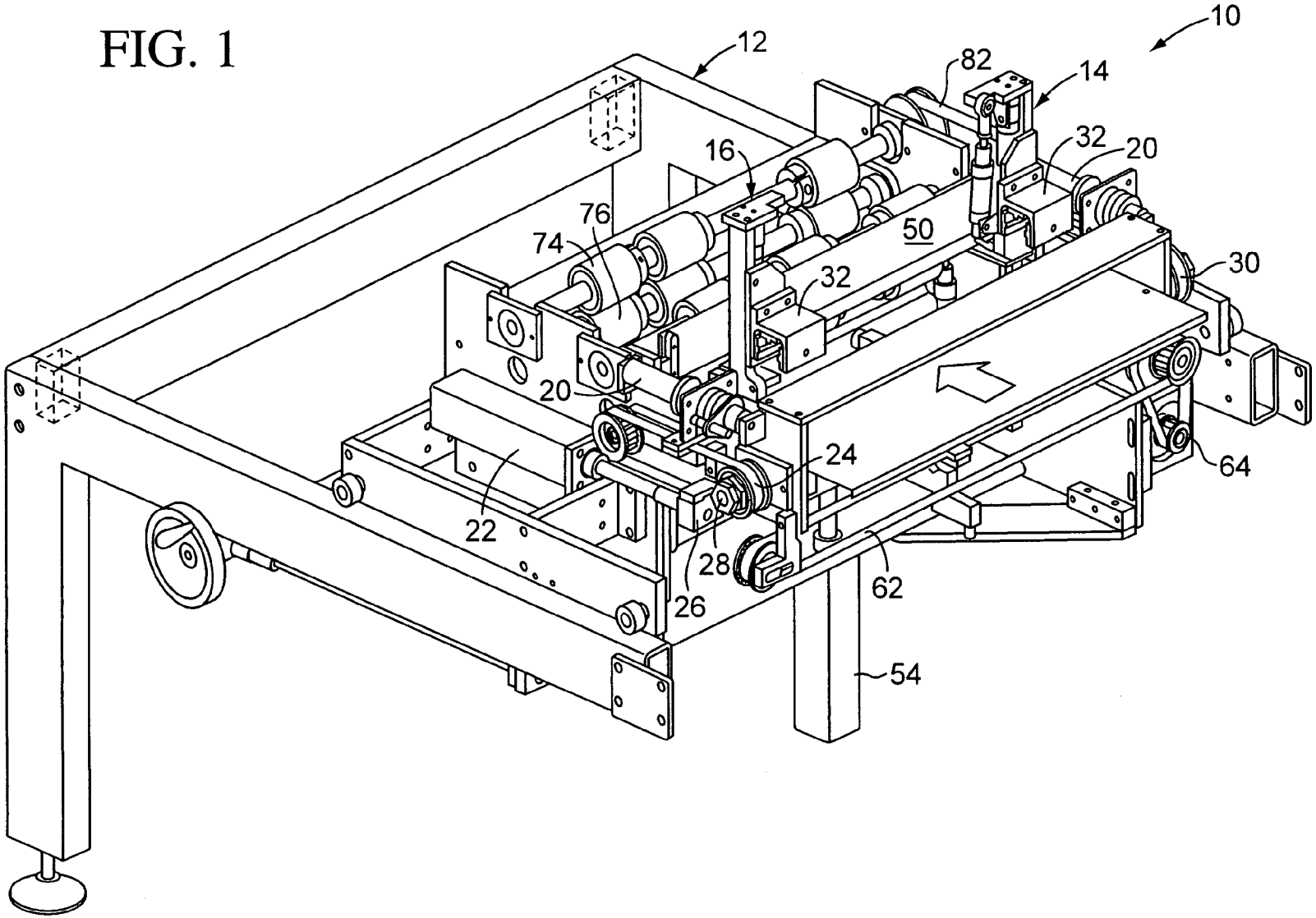
FIG. 1 is a diagrammatic, perspective view of a bag sealing apparatus embodying the principals of the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference to the drawings, therein is illustrated a bag sealing apparatus 10 embodying the principles of the present invention. Sealing apparatus 10 is intended for operative association with a suitable bag-making machine, which typically is configured to form a web of suitable bag-making material into a generally elongated tubular configuration. The tubular bag may be provided with inwardly extending side gussets, as are known in the art. The present sealing apparatus successively receives bags to be provided with a folded bottom seal one-at-a-time from the associated bag-making apparatus, with the bags cut to length, and ready for formation of a bottom seal by sealing apparatus 10.

Sealing apparatus 10 includes a frame 12 upon which the various gripper, folding, adhesive-applying, and web drawing mechanisms of the present invention are positioned. Generally speaking, the present apparatus is operated by advancing the unsealed tube-like bag longitudinally through the apparatus (generally in a right-to-left direction, referring to the orientation of FIG. 1), with the apparatus operating to grip opposite edges of the bag, and laterally pull on the opposite edges. Thereafter, the apparatus effects folding of an end portion of the bag, and application of adhesive to the folded end portion. The folded end portion of the bag is advanced into at least one pair of cooperating nip rollers, and the edge portions of the bag released. The nip rollers are then cycled to seal the folded end portion of the bag, and advance the now-sealed bag through the apparatus.

Figure 2:
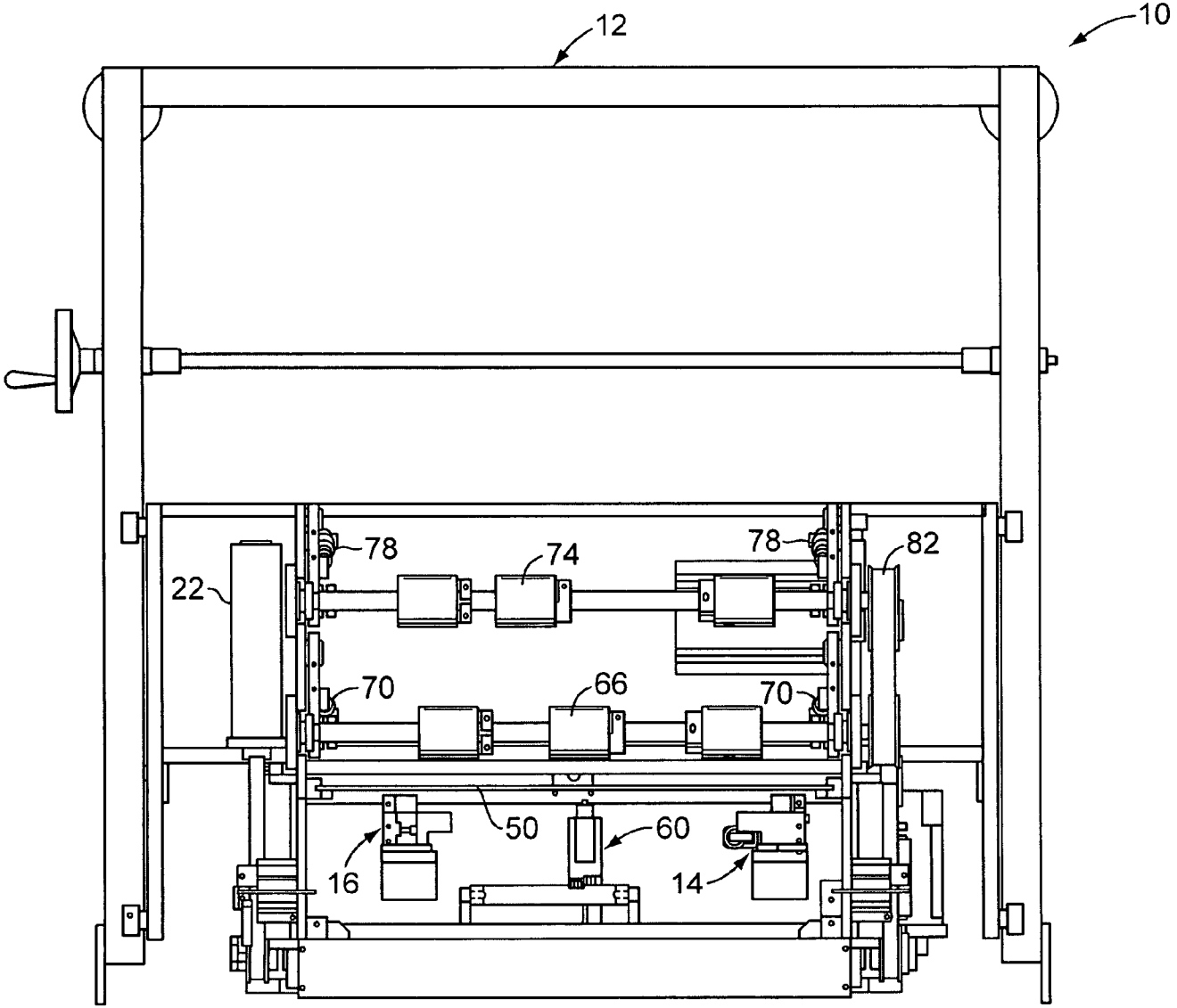
FIG. 2 is a diagrammatic, top plan view of the apparatus shown in FIG. 1.
Figure 3:
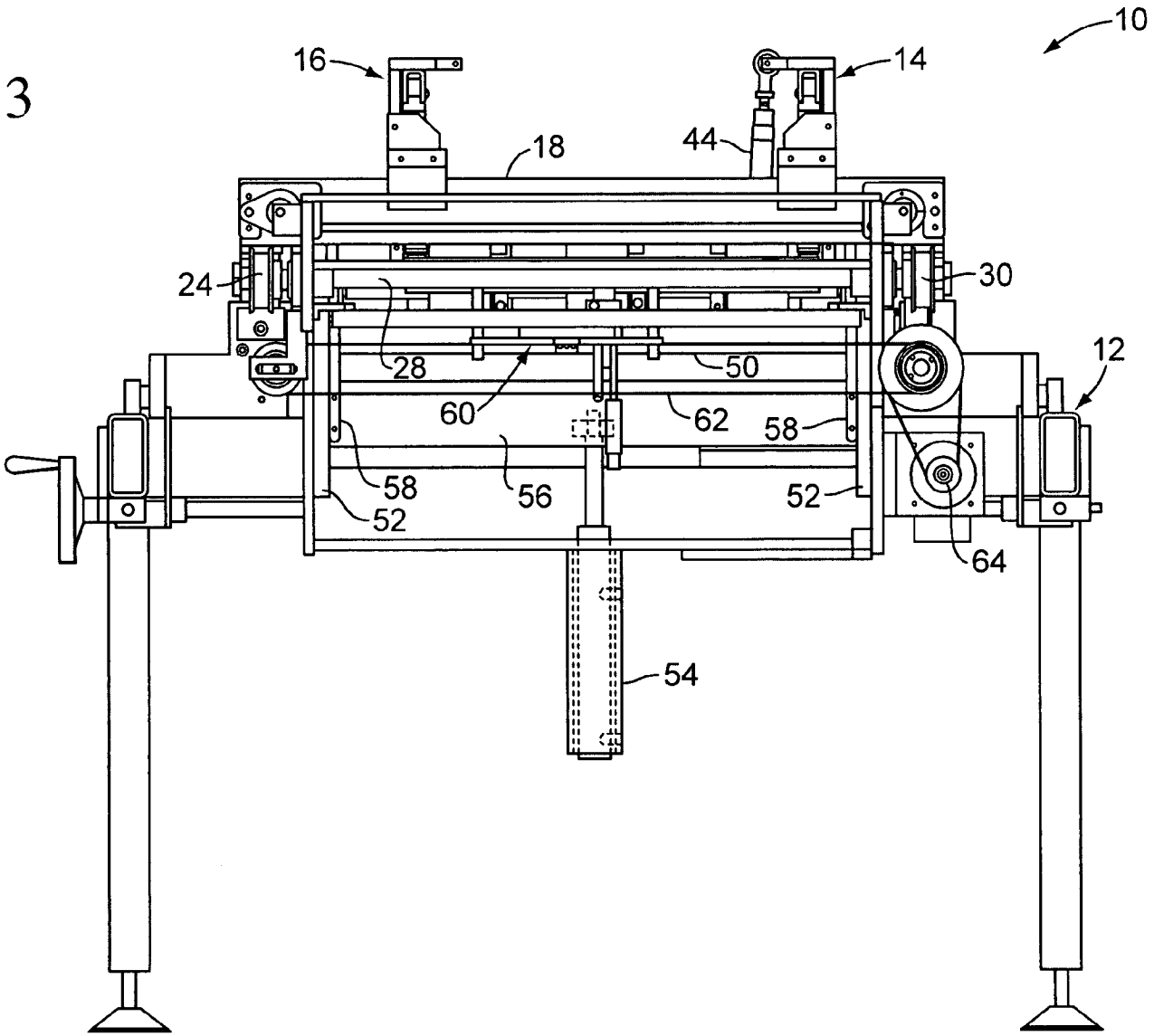
FIG. 3 is a diagrammatic, end elevational view of the present apparatus.
Figure 4:
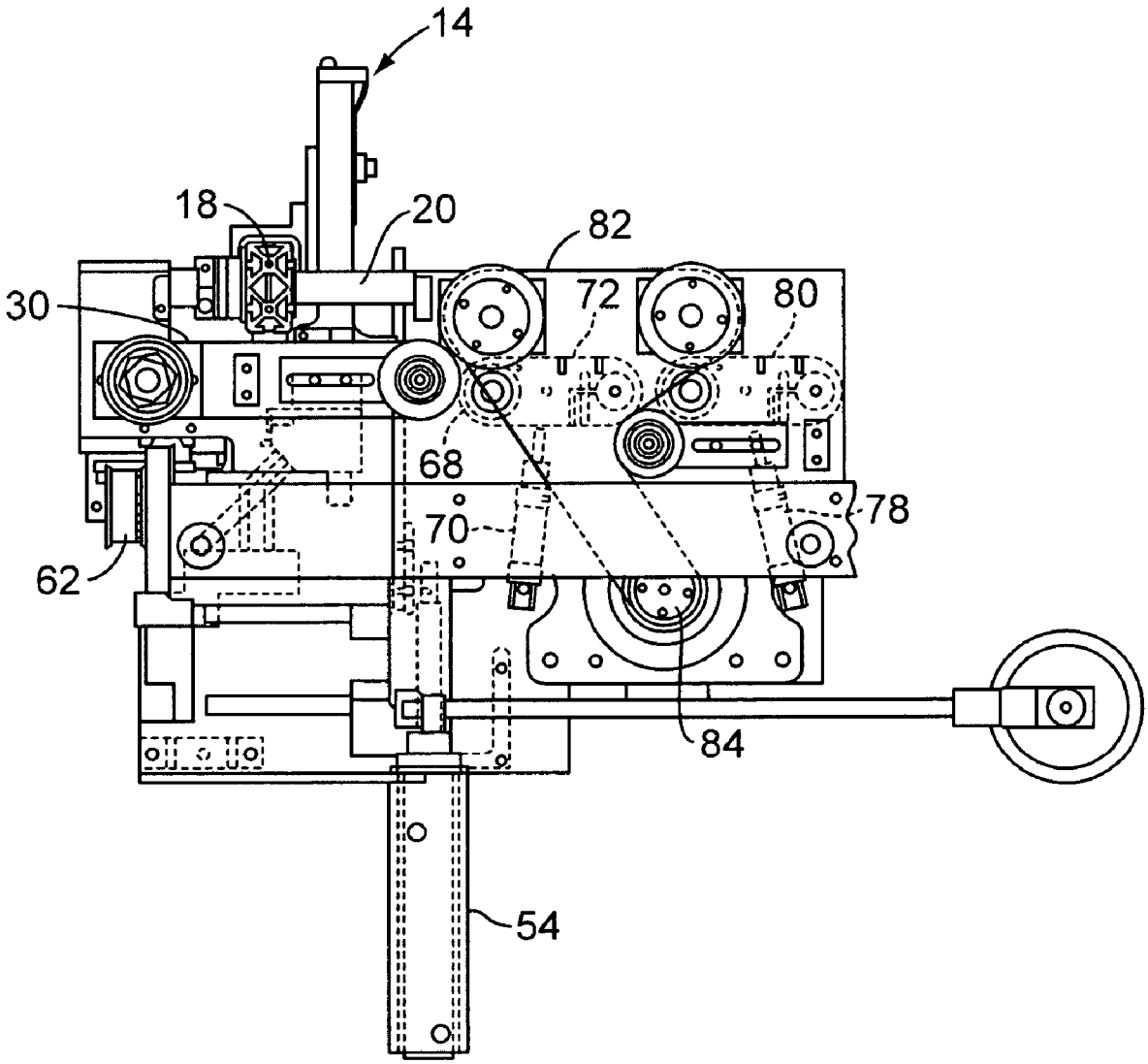
FIG. 4 is a diagrammatic, side elevational view of the present apparatus.
Figure 5:
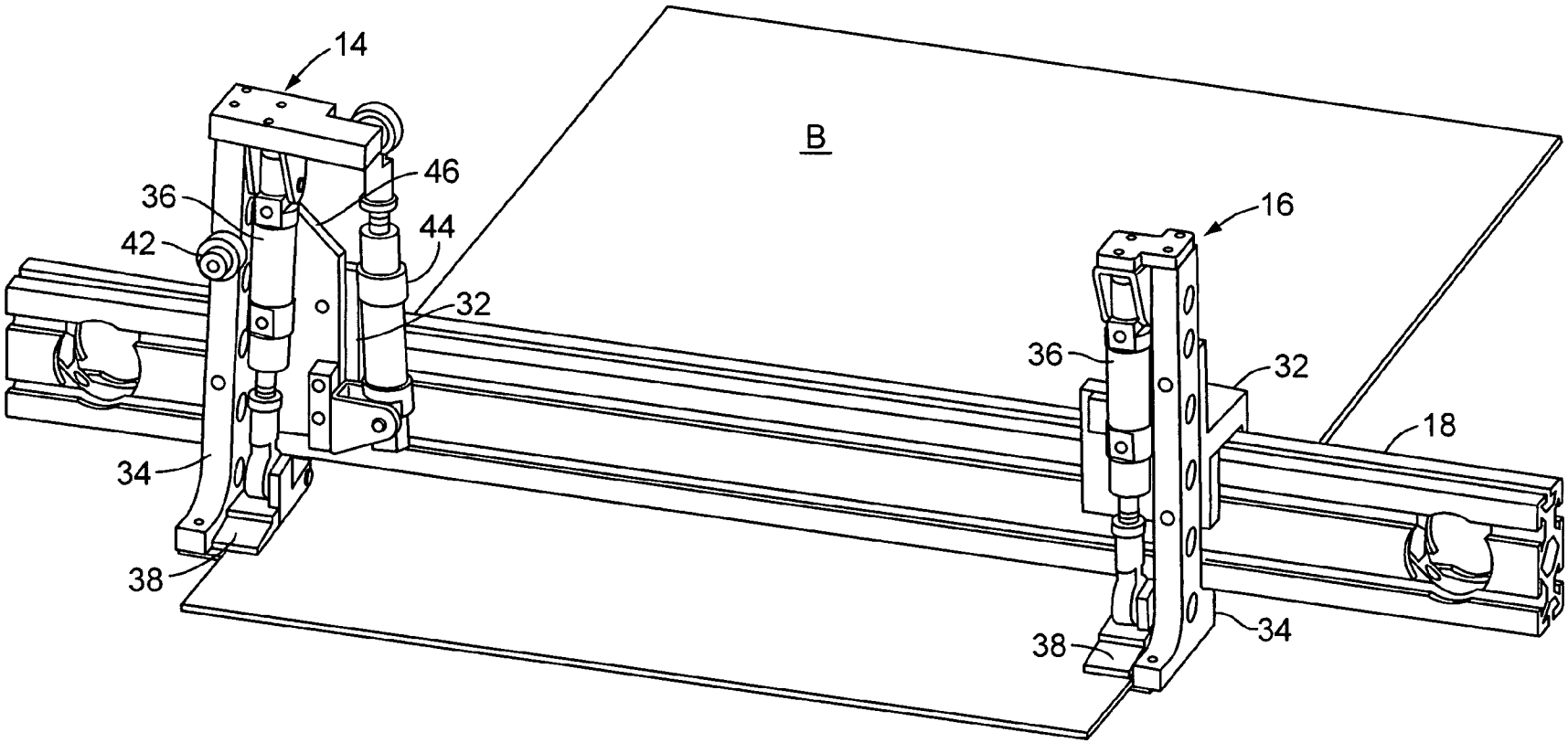
FIG. 5 is a diagrammatic, perspective view of cooperating grippers of the present apparatus.

The mechanism for gripping and laterally pulling or stretching the edge portions of the bag will now be described. Apparatus 10 includes a pair of grippers 14, 16 which are positioned for engaging and gripping respective opposite edge portions of a bag, designated B in FIG. 5. Grippers 14, 16 are mounted on a transversely extending gripper carrier 18, with the gripper carrier 18 mounted for movement longitudinally of apparatus 10 by a pair of slide supports 20. It will be observed that for clarity, gripper carrier 18 has not been illustrated in FIG. 1 or 2.

Reciprocable, longitudinal movement of the gripper carrier 18, and thus grippers 14, 16, is effected by a pneumatic cylinder 22, which is operatively connected with a drive belt 24. Drive belt 24 is trained about a pair of pulleys, with the pneumatic cylinder 22 operatively connected with the drive belt via a drive block 26.

A drive shaft 28 extends transversely of apparatus 10, and thus connects one of the pulleys upon which drive belt 24 is mounted with a similar pulley on the opposite side of apparatus 10, which in turn acts to concurrently drive a drive belt 30.

Opposite ends of longitudinally reciprocable gripper carrier 18 are operatively connected with upper runs of the drive belts 24, 30. Thus, the action of gripper cylinder 22 acts to reciprocably, longitudinally move the gripper carrier 18, and the grippers 14 and 16 mounted thereon.

As noted, each of grippers 14, 16 is mounted on gripper carrier 18 for movement therewith longitudinally of apparatus 10. In particular, each of the grippers 14, 16 is mounted on gripper carrier 18 by a respective gripper mount 32, with the gripper mounts permitting adjustable lateral positioning of the grippers 14, 16 for accommodating bags of different widths.

Each of the grippers 14, 16 includes a gripper frame 34 which carries a respective gripper cylinder 36, and a vertically movable gripper foot 38, which cooperates with a cooperating gripping surface which projects inwardly from beneath the respective gripper frame.

In order to effect the desired movement of the grippers away from each other during sealing of the bottom of bag B, one of the grippers is mounted for movement, preferably pivotal movement, on the gripper carrier 18. In particular, the frame 34 of gripper 14 is pivotal about a pivot 42 by operation of a pivot cylinder 44 having one end connected to the frame 34, and the other end connected to a plate 46 which supports pivot 42. Plate 46, in turn, is rigidly mounted to gripper mount 32 on gripper carrier 18. Thus, operation of pivot cylinder 44 to retract the cylinder acts to move the gripper foot 38 of the gripper 14 outwardly and away from the gripper foot 38 of gripper 16, thus acting to laterally pull on the edges of the bag B.

The mechanism for downwardly folding the leading edge portion of bag B will now be described. Folding of the end portion of the bag is effected by a vertically movable fold plate 50 mounted for reciprocable vertical movement by suitable plate guides 52 at opposite ends thereof. The fold plate 50 defines a lower edge for engaging the bag and folding the end portion thereof, and further defines an upper edge which engages the folded end portion of the bag, when the fold plate is in its lowered position, and as the gripper carrier 18 is longitudinally advanced to advance the folded bag through the sealing apparatus 10. This engagement of the folded end with the upper edge of the fold plate desirably acts to further fold the end of the bag generally through a further 98° of movement.

The folding plate 50 further defines an expansive surface, between the upper and lower edges thereof, which desirably cooperates with the adhesive applicator, as will be described, during adhesive application. After the fold plate has moved downwardly from its upper position to its lower position, downwardly folding the leading edge portion of the bag generally 90°, the fold plate remains in its lowered position, thus acting as a backing member to support the downwardly folded edge portion as adhesive is applied thereto. Thus, the folded end portion of the bag is positioned between the expansive surface of the fold plate, and the associated adhesive applicator, during application of adhesive to the folded end portion.

Reciprocable vertical movement of the fold plate 50 is effected by a plate cylinder 54 which acts through a cross member 56, which in turn is connected to, in vertically spaced relationship, to fold plate 50 by a pair of vertical connectors 58. Thus, by operation of plate cylinder 54, fold plate 50 reciprocates vertically with respect to the frame of the sealing apparatus. By virtue of the spacing provided between cross-member 56 and fold plate 50, a bag to be folded can be moved through the opening defined between the fold plate and the cross-member, and the cylinder 54 thereafter operated to move fold plate downwardly for folding the end portion of the bag which has been advanced into the sealing apparatus.

As noted, fold plate 50 remains in its lowered position, after the end portion of bag B has been folded, and adhesive applied thereto, so that further advancement of the bag B causes its folded end portion to engage an upper edge of fold plate 52, thus further folding the end portion as the fold line of the bag is advanced to cooperating nip rollers of the apparatus, as will be further described.

After the end portion of bag B has been folded downwardly as fold plate 50 is lowered, adhesive is applied for sealing the end portion, preferably by application of adhesive to the folded end portion. To this end, the apparatus 10 includes an adhesive applicator 60. Applicator 60 is mounted on frame 12 for movement transversely thereof, with transverse movement of the applicator effected by driven movement of adhesive drive belt 62 by adhesive drive motor 64. By this arrangement, adhesive can be applied to the downwardly folded end portion of the bag B across the width of the bag as the adhesive applicator 60 is moved transversely across the frame by operation of drive motor 64 and drive belt 62. As noted, during adhesive application, it is preferred that fold plate 50 remains in its lower position, the expansive surface of the fold plate thus acting as a backing member for the folded end portion of the bag as adhesive is applied thereto. Thus, the folded end portion of the bag is positioned between the expansive surface of the fold plate 50 and the adhesive applicator 60 during adhesive application.

During adhesive application, it is preferred that edges of the bag be retained by grippers 14, 16, with the grippers pulling laterally on the bag to maintain it in a taut condition during folding and adhesive application. After adhesive application, gripper cylinder 22 is operated for advancing gripper carrier 18, and grippers 14 and 16, longitudinally of the frame 12 for advancing the bag B over the lowered fold plate 50, and into the cooperating nip rollers of the apparatus, as will now be described.

In order to complete sealing of the bottom of the bag by compression of the folded end portion, movement of gripper carrier 18 acts to advance the bag, in particular, a fold line defined by the folded end portion, into at least one pair of cooperating nip members, which in the illustrated embodiment, comprise upstream and downstream pairs of nip rollers. The nip rollers are intermittently driven, in unison, with the upstream pair of nip rollers being openable to facilitate advancement of the folded bag end therebetween. Thereafter, the upstream nip rollers are closed, and the grippers 14, 16 released. Operation of the nip rollers thereafter acts to advance the bag through the sealing apparatus 10, with the compression applied to the bag by the nip rollers acting to complete formation of the sealed bottom for the bag.

The upstream nip rollers include an upper nip roll 66 and a lower nip roll 68, with the lower nip roll 68 being vertically movable toward and away from the upper nip roll, thereby permitting the nip defined by the rolls to be selectively opened. A pair of nip cylinders 70 operate through respective swing arms 72 which support the lower nip roll 68. By operation of nip cylinders 70, the nip between the upper and lower rolls 64, 66 can be opened to facilitate advancement of the folded end of bag B therebetween, with the nip cylinders 70 thereafter operated to close the nip.

A downstream pair of upper and lower nip rolls 74, 76 receive the folded bag from the upstream pair of nip rolls, acting to further compress and seal the bag bottom. Pressure between the nip rolls is provided by a pair of nip cylinders 78, which respectively act through a pair of swing arms 80 to urge lower nip rolls 76 against upper nip roll 74.

The upstream and downstream pairs of nip rolls are intermittently driven in unison via a nip drive belt 82, which is operated by a nip drive motor 84. In the illustrated embodiment, the upper nip rolls 66, 74 are driven by the drive belt 82, with the bag web advancing through the nip rolls acting to effect concurrent, counter-rotation of the respective lower nip rolls.

From the foregoing description, operation of the present apparatus will be readily appreciated. A bag to be folded and sealed is advanced into the apparatus so that it extends between grippers 14, 16, and generally beneath fold plate 50, which is initially positioned in its raised position. Grippers 14 and 16 are operated to engage and grip the opposite edges of the bag, and pivot cylinder 44 operated to pivot gripper 14 so that it moves away from gripper 16, thus laterally pulling on the edges of the bag.

Fold plate 50 is lowered, thereby downwardly folding the edge portion of the bag as it is held by the grippers 14, 16. Adhesive applicator 60 is operated so as to apply adhesive to the downwardly-folded end portion of the bag, the expansive surface of fold plate 50 acting as a backing member during adhesive application.

With the fold plate 50 maintained in its lowered position, gripper carrier 18 is advanced by operation of gripper cylinder 22, which acts through drive belts 24 and 30, and drive shaft 28, to advance the gripper carrier, with grippers 14, 16 mounted thereon. During advancement, the folded end portion of the bag engages the upper edge of fold plate 50, thus further folding the end portion.

Continued advancement of gripper carrier 18 moves the fold line of the bag into the open nip defined by the upstream pair of nip rollers 66, 68, with lower nip roller 68 in a lowered or open position to facilitate advancement in this fashion. Nip cylinders 70 are thereafter operated to move lower nip roll 68 upwardly and close the nip, capturing the folded end of bag B between the upper and lower nip rollers 66, 68.

Grippers 14, 16 are now operated to release the edge portions of the bag, which permits gripper carrier 18 to be retracted, by operation of gripper cylinder 22, back to its initial position. The bag is now held by the closed nip of upstream rollers 66, 68, with operation of nip drive 84, acting through belt 82 to drive the upstream and downstream pair of nip rollers to effect compression and sealing of the folded end portion of the bag. The nip drive 84 is operated so as to advance the folded and sealed bag out of the apparatus.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. An apparatus for sealing the bottom of a bag, comprising:

a frame through which said bag is advanced in a longitudinal direction;

a pair of edge grippers mounted on a gripper carrier movably mounted on said frame, said grippers being engageable with respective opposite edges of said bag, and movable away from each other for gripping and laterally pulling on said edges of said bag;

a folding plate mounted on said frame for engaging said bag and folding an end portion of said bag to define a fold line;

an adhesive applicator mounted on said frame for applying adhesive to the folded end portion of said bag;

at least one pair of cooperating nip rollers for receiving said fold line of said bag; and a carrier drive for advancing said gripper carrier and said pair of edge grippers longitudinally of said frame to advance said fold line of said bag between said pair of cooperating nip rollers.

2. An apparatus for sealing the bottom of a bag in accordance with claim 1, wherein:

said folding plate defines a lower edge for engaging said bag and folding said end portion, said folding plate defining an upper edge which engages said folded end portion as said carrier drive advances said gripper carrier and said pair of edge grippers.

3. An apparatus for sealing the bottom of a bag in accordance with claim 1, wherein:

said folding plate defines an expansive surface, said folded end portion being positioned between said expansive surface and adhesive applicator during application of adhesive to said folded end portion.

4. An apparatus for sealing the bottom of a bag in accordance with claim 1, wherein:

said carrier drive includes a pair of carrier drive belts mounted on respective opposite sides of said frame to which respective opposite ends of said gripper carrier are operatively connected.

5. An apparatus for sealing the bottom of a bag in accordance with claim 3, wherein:

said carrier drive further includes a drive shaft operatively connecting said carrier drive belts, and a pneumatic cylinder for reciprocably driving one of said carrier drive belts to reciprocably advance and retract said gripper carrier.

6. An apparatus for sealing the bottom of a bag in accordance with claim 1, wherein:

one of said grippers is pivoted relative to said gripper carrier so that pivotal movement of said one gripper moves said pair of grippers away from each other.

7. An apparatus for sealing the bottom of a bag in accordance with claim 1, wherein:

said pair of nip rollers are relatively movable away from each other for receiving said fold liner of said bag between said pair of nip rollers.

8. An apparatus for sealing the bottom of a bag in accordance with claim 7, wherein:

said nip rollers are intermittently driven.

9. An apparatus for sealing the bottom of a bag in accordance with claim 1, wherein:

said adhesive applicator is mounted for movement transversely of said frame, said apparatus including an applicator drive for transversely moving said applicator.

10. An apparatus for sealing the bottom of a bag in accordance with claim 1, wherein:

said one of said grippers is pivotally mounted for movement of said gripper carrier.

11. An apparatus for sealing the bottom of a bag, comprising:

a frame through which said bag is advanced in a longitudinal direction;

a pair of edge grippers mounted on a gripper carrier movably mounted on said frame, said grippers being engageable with opposite edges of said bag, one of said grippers being movably mounted on said gripper carrier so that said grippers are movable away from each other for gripping and laterally pulling on said edges of said bag;

a folding member mounted on said frame for engaging said bag and folding an end portion of said bag to define a fold line;

an adhesive applicator mounted on said frame for applying adhesive to the folded end portion of said bag;

at least one pair of nip members for receiving said fold line of said bag; and a carrier drive for advancing said gripper carrier and said pair of edge grippers longitudinally of said frame to advance said fold line of said bag between said pair of nip members.

12. An apparatus for sealing the bottom of a bag in accordance with claim 11, wherein:

said folding member comprises a vertically movable folding plate.

13. An apparatus for sealing the bottom of a bag in accordance with claim 11, wherein:

said nip members comprise a pair of cooperating nip rollers.

14. An apparatus for sealing the bottom of a bag in accordance with claim 11, wherein:

said adhesive application is mounted for movement transversely of said frame.

* * * * *